United States Patent [19]

Reina

[11] 4,290,535

[45] Sep. 22, 1981

[54] SEALING BUNG FOR BOTTLE CLOSURES

[75] Inventor: Erminia Reina, Milan, Italy

[73] Assignee: Alucaps Italiana S.p.A., Italy

[21] Appl. No.: 101,002

[22] Filed: Dec. 6, 1979

[30] Foreign Application Priority Data

Apr. 11, 1979 [IT] Italy ..... 21330/79[U]

[51] Int. Cl.[3] ..... B65D 53/00

[52] U.S. Cl. ..... 215/270; 215/354; 215/DIG. 1

[58] Field of Search ..... 215/270, 341, 354, DIG. 1

[56] References Cited

U.S. PATENT DOCUMENTS

| | | | |
|---|---|---|---|
| 2,582,721 | 1/1952 | Roshkind | 215/354 X |
| 2,848,130 | 8/1958 | Jesnig | 215/270 X |
| 3,275,178 | 9/1966 | Lovell | 215/354 X |
| 3,979,004 | 9/1976 | Bertario | 215/354 X |

FOREIGN PATENT DOCUMENTS

| | | | |
|---|---|---|---|
| 504063 | 7/1951 | Belgium | 215/354 |
| 72656 | 11/1959 | France | 215/354 |
| 2381675 | 10/1978 | France | 215/270 |
| 352249 | 3/1961 | Switzerland | 215/354 |
| 698130 | 10/1953 | United Kingdom . | |
| 780286 | 7/1957 | United Kingdom . | |
| 1042571 | 9/1966 | United Kingdom . | |
| 1297357 | 11/1972 | United Kingdom . | |

*Primary Examiner*—Donald F. Norton

*Attorney, Agent, or Firm*—McGlew and Tuttle

[57] ABSTRACT

The disclosure describes a seal bung for the closure of a bottle, comprising a central body, a part for sealing hold against the bottle glass finish internal wall, and an annular flange with bell-shaped edge, suitable for being held in an internal groove of the metal closure and hugging the rim of said glass finish. The seal bung comprises a central hollow body, an inward-looking closed bottom an annular flange extending from the top of the central body circumferential wall, said part being composed by a lip extending from the flange towards the inside of the bottle and separated from said wall so that it forms an annular hollow space communicating with the inside of the bottle.

9 Claims, 2 Drawing Figures

SEALING BUNG FOR BOTTLE CLOSURES

BACKGROUND OF THE INVENTION

The invention relates to a sealing bung for bottle closures.

A glass bottle is often closed by means of a metal closure, rolled on the threaded end of the glass finish itself, and a bung composed of elastic substance, usually plastic, that must guarantee the seal of the closure against liquid or gaseous leakage.

If the bottle will contain a liquid which is to be subjected to pasteurization, there is the possibility that, during this treatment and because of the high temperatures involved, the plastic bung will lose its elasticity and soften, thus causing loss of the seal on the bottle.

This danger also exists in the presence of high pressures or the development thereof.

Loss of seal has been typically prevented by thickening the bung's walls, however, causes great difficulties during the insertion of the bung itself into the bottle.

SUMMARY OF THE INVENTION

The present invention is directed to a novel bung for joint use with a bottle closure, which is therefore apt for perfect holding of the seal even following heating, for example following pasteurizatin of the bottle contents, or if there is overpressure in the bottle, and which may be inserted in the bottle without difficulty.

In accordance with the invention, a bung, preferably made of molded plastic, comprises a hollow body, a part destined for a sealing contact against the glass finish wall of a bottle, and an annular flange at one end having bell-shaped edge, suitable for being held in an internal groove of the metal closure and hugging the rim of the opening of a glass bottle or the like.

The bung is characterized by the fact that its central body is hollow, that is has an inward projecting and closed bottom (when the bung is applied to the opening of a bottle). An annular flange extends from the top of the circumferential wall of the central body and includes a lip extending from the above-mentioned flange towards the inside of the bottle for sealing the opening. The lip is separated from the circumferential wall of said central body so that, together with the said circumferential wall, it forms an annular hollow space freely communicating with the inside of the bottle.

Preferably, said extending lip present a double conicity, while the central body is in the shape of a simple truncated cone, having its smaller base disposed towards the inside of the bottle. Reinforcing radial ribs can be provided in the central hollow body.

It is an object of the invention to provide an improved closure assembly for sealingly closing an opening of a bottle having a closure member and a bung mounted to the closure member, the bung being of the type adapted to be sealingly received in the opening which includes, in combination, a hollow frusto-conical member having an open larger end and a closed smaller end, an annular flange attached about the periphery of the larger end and including an edge extending therefrom adapted for engagement with the closure member and the bottle, and a lip extending from the annular flange intermediate the edge and the frusto-conical member.

It is a further object of the invention to provide a bung which is simple in design, rugged in construction and economical to manufacture.

IN THE DRAWINGS

DETAILED DESCRIPTION OF THE PREFERRED EMBODIMENT

Figure 1:
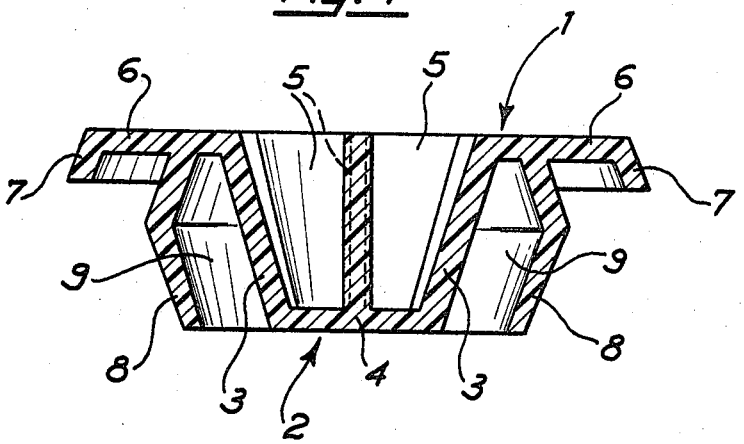
FIG. 1 shows a cross section of a plastic seal bung in accordance with the invention.

As the drawing indicates, the seal bung, indicated in its entirety with 1, comprises a frusto-conical member or central hollow body 2 with a circumferential wall in the shape of a truncated cone 3 and with a closed bottom 4 which projects towards the inside of a bottle when the bung is applied to the opening of the bottle. The central body 2 is open towards the outside of the bottle at its larger end. Reinforcing ribs 5 are disposed within the hollow of the central body 2, in engagement with the circumferential wall, and are in the form of a cruciform.

An annular flange 6, with bell-shaped skirt or edge 7 at the radially outer periphery of the annular flange extends, at its radially inner periphery, about the outer periphery of the top of the circumferential wall 3 of the central body 2.

Figure 2:
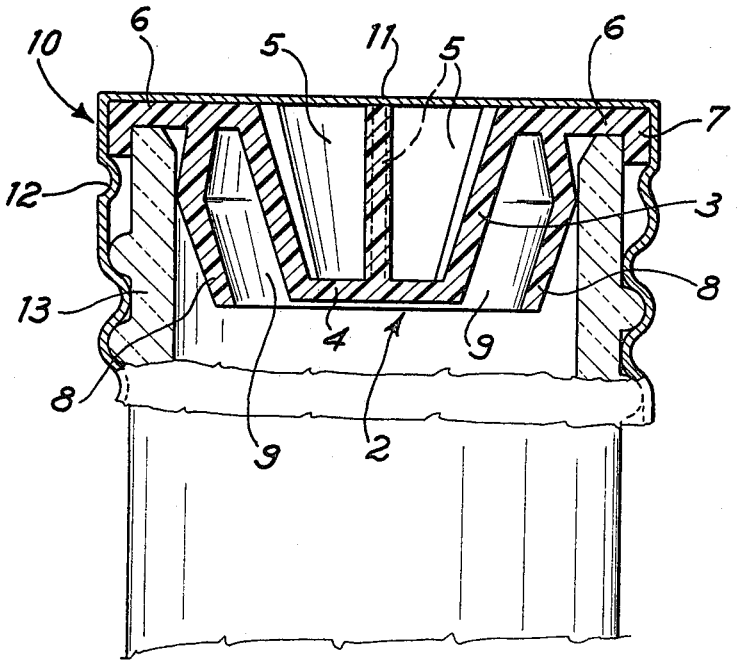
FIG. 2 shows a section illustrating a closure screwed on to the bottle's glass finish and containing the seal bung of FIG. 1.

A lip 8 depends from the flange 6 intermediate edge 7 and the central body 2. This lip is separated from the circumferential wall 3 of the main body 2 so that, together with said wall, it forms a hollow space 9 which is designed to freely communicate with the inside of the bottle sealed by the bung, as can be seen in FIG. 2. For use, the bung 1 is forced into a metal closure 10 so that its edge 7 is pushed out of shape to fit between and engage a bottom 11 and an internal groove 12 provided in the closure 10 itself.

When the bung-closure assembly, thus made, is applied to the threaded glass neck of the bottle the shape of the double-cone lip 8 is distorted, as shown in FIG. 2, so that the lip 8 is adapted to the internal configuration of the wall of the glass neck, against which lip 8 of bung 1 exercises its sealing pressure. Hollow space 9, between lip 8 and wall 3 of central body 2 of bung 1, freely communicates with the inside of the bottle.

Therefore, if there is overpressure in the bottle, and, accordingly hollow space 9, lip 8 is pressed against the surface of internal wall 13 and compensating pressure is developed on lip 8 between the external surface thereof and the internal wall of the glass finish 13.

Perfect seal is thus guaranteed even if the bung's material has softened during a pasteurizing process, or if there is a certain overpressurein the bottle or both.

At the same time, the insertion of the bung into the opening of the bottle can be performed with ease, as the sealing lip yields elastically, and can thus have a very small thickness.

All parts composing the bung can be made in a single molding step.

The lip can have a smaller thickness than the central body walls and the annular flange. It can be especially reduced toward its free end, as clearly shown in FIG. 1.

The internal ribbing of the central body is not essential, but is strongly recommended, as it renders the central part of the bung stiffer, thus guaranteeing its stability, as only the lip has to seal the bottle. In fact, the central part must not fall out of shape under the internal pressure of the bottle.

While a specific embodiment of the invention has been shown and described in detail to illustrate the application of the principles of the invention, it will be understood that the invention may be embodied otherwise without departing from such principles.

I claim:

1. An improved bung for use in sealing an opening of a container in combination with a closure for the container, the improved bung comprising an annular flange, an edge depending from the radially outer periphery of said annular flange, a hollow central body depending from the radially inner periphery of said annular flange, said central body being cone-shaped, said central body having a closed smaller end remote from said annular flange and an open larger end, and a lip depending from said annular flange at a location intermediate and radially spaced from said central body and said edge, whereby said lip is adapted for sealingly engaging a surface of the container about the opening and said annular flange and edge are adapted for disposition against the closure.

2. The bung as defined in claim 1, wherein said lip is concentric of said central body and said edge.

3. The bung, as defined in claim 2, further comprising reinforcing ribs provided in the inside of the central body.

4. The bung, as defined in claim 1, wherein said lip has a thickness smaller than the thickness of the walls of the central body and flange.

5. The bung, as defined in claim 4, further comprising reinforcing ribs provided in the inside of the central body.

6. The bung, as defined in claim 1, wherein the thickness of the lip decreases toward its edge remote from said annular flange.

7. The bung, as defined in claim 6, further comprising reinforcing ribs provided in the inside of the central body.

8.The bung, as defined in claim 1, further comprising reinforcing ribs provided in the inside of the central body.

9. An improved closure assembly for sealingly closing an opening having a closure member and a bung mounted to the closure member, the bung being of the type adapted to be sealingly received in the opening comprising, in combination, an annular flange, a hollow frusto-conical member depending from the radially inner periphery of said annular flange, said frust-conical member having an open larger end and a closed smaller end remote from said annular flange, an edge depending from the radially outer periphery of said annular flange in engagement with the closure member, a lip extending from said annular flange intermediate said edge and said frusto-conical member, and reinforcing means disposed within the hollow of said frusto-conical member and engaging said frusto-conical member for reinforcement, said reinforcing means including a rib in the form of a cruciform.

* * * * *